United States Patent [19]

Shimosato et al.

[11] Patent Number: 4,925,625

[45] Date of Patent: May 15, 1990

[54] DOT PRINT HEAD HAVING A TORSION BAR WITH ELASTIC PORTIONS

[75] Inventors: Masashi Shimosato; Kuniaki Ochiai, both of Mishima, Japan

[73] Assignee: Tokyo Electric Company, Ltd., Tokyo, Japan

[21] Appl. No.: 257,883

[22] Filed: Oct. 14, 1988

[30] Foreign Application Priority Data

Oct. 15, 1987 [JP] Japan ..... 62-260699
Jan. 8, 1988 [JP] Japan ..... 63-002087

[51] Int. Cl.[5] ..... B41J 3/02

[52] U.S. Cl. ..... 400/124; 101/93.05; 228/215

[58] Field of Search ..... 400/124; 101/93.05; 228/215

[56] References Cited

U.S. PATENT DOCUMENTS 3,842,955 7/1958 Iwasaki ..... 400/124
4,634,301 1/1987 Sakaida ..... 400/124

FOREIGN PATENT DOCUMENTS 35736 3/1977 Japan ..... 228/215
120257 9/1979 Japan ..... 228/215
58-008665 1/1983 Japan .
60-147 1/1985 Japan ..... 400/124
61-44656 3/1986 Japan .
61-121958 6/1986 Japan ..... 400/124
570464 8/1977 U.S.S.R. ..... 228/215
1478498 6/1977 United Kingdom ..... 228/215

*Primary Examiner*—Eugene H. Eickholt
*Attorney, Agent, or Firm*—Oblon, Spivak, McClelland, Maier & Neustadt

[57] ABSTRACT

A dot print head including armatures, supporting parts for supporting the armatures, and torsion bars for supporting the armatures on the supporting parts. Open grooves are formed at least in either the armatures or the supporting parts to place the torsion bars therein, to contain a brazing filler metal therein and to braze the torsion bars to the armatures or the supporting parts by melting the brazing filler metal in the open grooves, and flanges are formed integrally with each torsion bar so as to be positioned between the elastic portions of the torsion bar and the open grooves. The width of the base end of each armature or that of each supporting part is reduced to form a gap between the armature and the supporting part in a width sufficient to form the elastic portion of the torsion bar in a length greater than a predetermined value.

4 Claims, 9 Drawing Sheets

DOT PRINT HEAD HAVING A TORSION BAR WITH ELASTIC PORTIONS

FIELD OF THE INVENTION AND RELATED ART STATEMENT

The present invention relates to an impact dot print head comprising styluses for a dot matrix printer and, more particularly, to an impact dot print head of respective a release type in which each one of armatures fixedly holding styluses is attracted resiliently to a core by the magnetism of a permanent magnet, a solenoid corresponding to a selected stylus is energized to cancel the magnetism of the permanent magnet to release the armature from the core so that the stylus is allowed to advance for printing a dot.

There is disclosed in Japanese Utility Model Laid-open (Kokai) No. 60-147 and Japanese Patent Laid-open (Kokai) Nos. 61-44656 and 61-121958 armature supporting mechanisms for a dot print head in which each of armatures disposed opposite a core fitted in a solenoid, and supporting parts disposed respectively on the opposite sides of the armature are connected by a torsion bar having elastic portions extending respectively on the opposite sides of the armature, the armature is turned on the torsion bar by energizing the solenoid to twist the torsion bar so that a stylus held on the armature advances to a platen for printing.

As shown in FIGS. 19, 20 and 21, in one of these known armature supporting mechanisms, an armature 50 is disposed between supporting parts 51, a torsion bar 52 is inserted in through holes 53 formed through the supporting parts 51 and the armature 50, and a brazing filler metal filled in brazing holes 54 formed in the armature 50 and the supporting parts 51 so as to be connected respectively to the middle portions of the through holes 53 is melted to braze the torsion bar 52 to the armature 50 and the supporting parts 51.

However, since the distance between the outer surfaces of the supporting parts 51 is as small as several millimeters, for example, on the order of 8 mm, the diameter of the through holes 53 must be on the order of 1 mm and that of the brazing holes 54 must be still smaller. Boring such small holes in the armature 50 and the supporting parts 51 and filling the brazing filler metal in the brazing holes 54 are difficult. Furthermore, the brazing filler metal is liable to flow over the elastic portions 55 of the torsion bar 52 when molten adversely affecting the twisting action of the elastic portions 55.

To braze the torsion bar 52 firmly to the armature 50 and the supporting parts 51, the width W of the armature 50 and the supporting parts 51 must be sufficiently large, and the width W must be greater than a value necessary for forming a magnetic path across the armature 50 and a corresponding core. On the other hand, to reduce stress in the torsion bar 52 so that the torsion bar 52 retains the original ability for a long time, the axial length L of the elastic portions 55 of the torsion bar 52 must be large and, to return the armature 50 at a high speed to its standby position, the elastic portions 55 must have a sufficiently large diameter. Thus, the axial length L of the elastic portions 55 must be sufficiently large to limit the stress in the elastic portions 55 of the torsion bar 52 to an optional magnitude and to secure an optional strength of the elastic portions 55 of the torsion bar 52. However, since the construction of the print head having an arrangement of a plurality of armatures 50 is enlarged when the width W of the armature 50 and the supporting parts 51 and/or the length L of the elastic portions 55 is increased, it is difficult to limit the stress in the elastic portions 55 to a desired value and to provide the elastic portions 55 with a desired strength.

OBJECT AND SUMMARY OF THE INVENTION

Accordingly, it is a first object of the present invention to fasten a torsion bar to supporting parts and an armature without boring the supporting parts and the armature.

It is a second object of the present invention to decide the axial position of a torsion bar accurately.

It is a third object of the present invention to prevent the flow of a brazing filler metal over the elastic portions of a torsion bar.

It is a fourth object of the present invention to secure sufficient brazing strength in brazing a torsion bar to supporting parts.

It is a fifth object of the present invention to provide a torsion bar having elastic portions having a sufficiently large axial length.

In one aspect of the present invention, in a dot print head, supporting parts, and an armature disposed between the supporting parts and opposite a core fitted in a solenoid are connected by a torsion bar having elastic portions extending on the opposite sides of the armature, and the armature is turned by varying magnetic flux to advance a stylus fixedly held on the armature toward a platen for printing, the torsion bar is fitted at least in either the armature or the supporting parts, open grooves for containing a brazing filler metal are formed in the armature and the supporting parts, and flanges are formed on the torsion bar at the opposite ends of the elastic portions so as to be contiguous with the side surfaces of the supporting parts and the armature, respectively. The torsion bar is fitted in the grooves, the brazing filler metal is filled in the grooves, and then the brazing filler metal is melted to braze the torsion bar to the supporting parts and the armature. The number of machined portions is reduced by half since the grooves receive both the torsion bar and the brazing filler metal, the flanges facilitate axially positioning the torsion bar with respect to the supporting parts and prevents the flow of the brazing filler metal over the elastic portions of the torsion bar, and the brazing strength is increased since the area of contact surfaces of the torsion bar in contact with the brazing filler metal is increased.

In another aspect of the present invention, an armature fixedly holding a stylus at the free end thereof is disposed opposite a core fitted in a solenoid, with the base end thereof positioned between supporting parts with predetermined gaps between the opposite sides thereof and the corresponding side surfaces of the supporting parts, open grooves for receiving a torsion bar having elastic portions to be extended on the opposite sides of the armature are formed respectively in the base end of the armature and the supporting parts, either the width of the base end of the armature or the width of the supporting parts is reduced to form increased gaps between the opposite side surfaces of the base end of the armature and the corresponding side surfaces of the supporting parts so that a torsion bar having elastic portions having an increased axial length can be employed, and flanges are formed on the torsion bar so as to be in contact with the side surfaces of the base end of the armature. Accordingly, the torsion bar is fitted in the grooves, a brazing filler metal is put in the grooves, and then the brazing filler metal is melted to braze the torsion bar to the armature and the supporting parts. Since the width of the base end of the armature or the width of the supporting parts is reduced to form sufficiently large gaps between the opposite side surfaces of the base end of the armature and the corresponding side surfaces of the supporting parts, the elastic portions of the torsion bar can be formed in a sufficiently large axial length. Thus, the strain in the elastic portions of the torsion bar and strength of the elastic portions of the torsion bar can optionally be decided, and the armature and the supporting parts can be arranged in a small space to form the print head in a small size.

DETAILED DESCRIPTION OF THE PREFERRED EMBODIMENTS

Dot print heads in preferred embodiments according to the present invention will be described with reference to the accompanying drawings.

First Embodiment (FIGS. 1 to 4)

Figure 3:
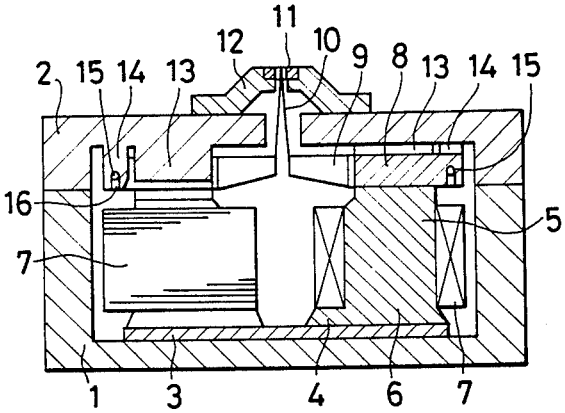
FIG. 3 is a longitudinal sectional side elevation showing the general construction of the dot print head in the first embodiment according to the present invention.

As shown in FIG. 3, an upper yoke 2 is joined to the open end of a lower yoke 1 having a U-shaped cross section. A permanent magnet 3 is extended on the inner bottom surface of the lower yoke 1. A plurality of solenoids 7 are mounted respectively on a plurality of cores 6 each having a foot 4 fixed to the permanent magnet 3, and a standing portion 5. An armature 8 disposed opposite the core 6 has a plate-shaped arm 9 projecting from the free end of the body thereof, and a stylus 10 is fixed to the extremity of the arm 9. A stylus guide 11 for slidably guiding the styluses 10 is fixed to a nose 12 fixed to the upper yoke 2. Projections 13 and supporting parts 14 are formed integrally with the upper yoke 2 on the inner surface of the latter. Each armature 8 is disposed between the adjacent projections 13 and is connected to the supporting parts 14 by a torsion bar 15.

Figure 4:
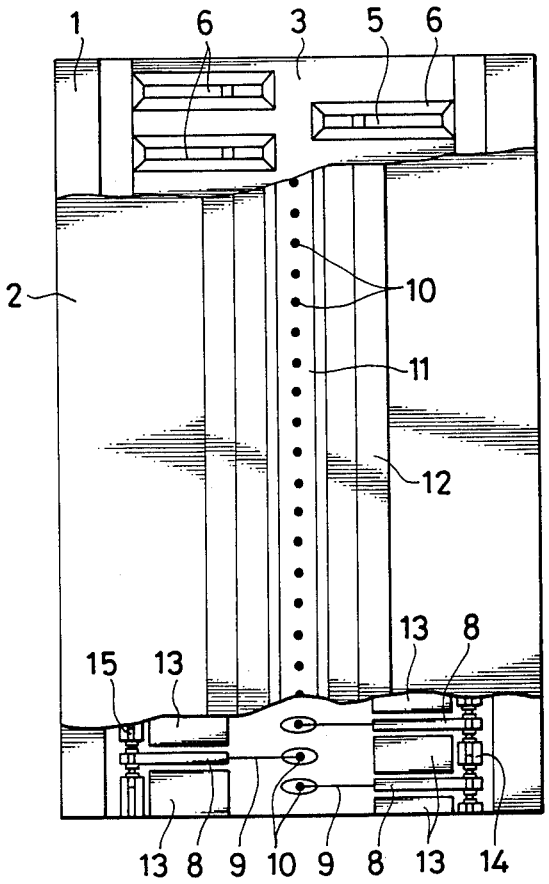
FIG. 4 is a partially cutaway plan view of the dot print head of FIG. 3.
Figure 5:
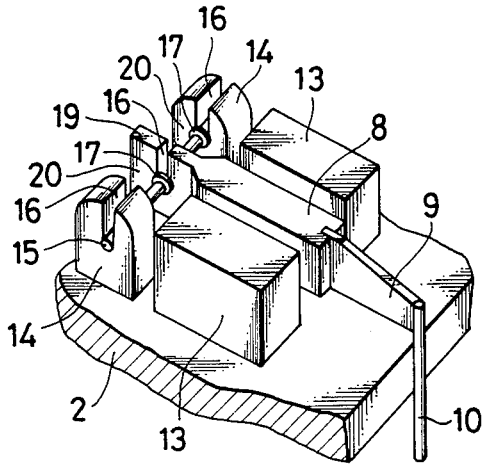
FIG. 5 is an enlarged perspective view of a dot print unit incorporated into a dot print head in a second embodiment according to the present invention.
Figure 6:
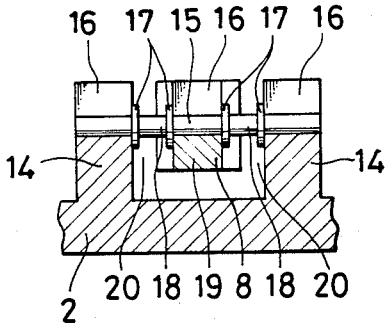
FIG. 6 is a longitudinal sectional side elevation of the dot print unit of FIG. 5.

In FIG. 4, an upper portion, as viewed in FIG. 4, of the upper yoke is partially cut away and the solenoids 7 are omitted to show the arrangement of the cores 6, and a lower portion, as viewed in FIG. 4, of the upper yoke 2 is partially cut away to show the arrangement of the armature 8, the projections 13 and the supporting parts 14. As shown in FIG. 4, a plurality of dot print units each comprising the core 6, the solenoid 7 and the armature 8 are arranged zigzag in two straight rows. The dot print units may be arranged in a circular arrangement.

Figure 1:
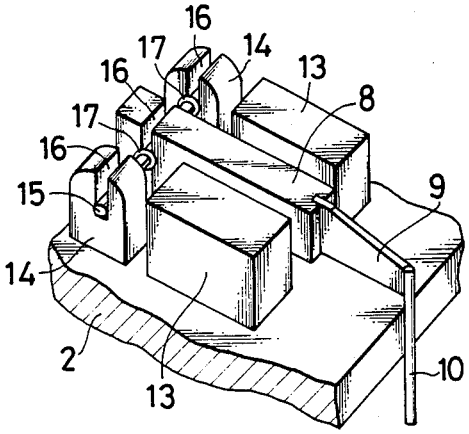
FIG. 1 is an enlarged perspective view of a dot print unit incorporated into a dot print head in a first embodiment according to the present invention, showing a construction for combining an armature and supporting parts.
Figure 2:
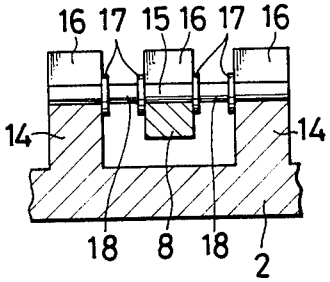
FIG. 2 is an enlarged fragmentary longitudinal sectional side elevation of the dot print unit of FIG. 1.

Referring to FIGS. 1 and 2 showing a portion of the inner surface of the upper yoke 2, the torsion bar 15 is placed in U-shaped grooves 16 respectively formed in the armature 8 and the supporting parts 14. The torsion bar 15 is formed of an elastic low-carbon nickel-rich alloy steel. The torsion bar 15 has elastic portions 18 having a small diameter and extending on the opposite sides of the armature 8, and flanges 17 formed at the opposite ends of the elastic portions 18 so as to be contiguous respectively with the side surfaces of the armature 8 and those of the supporting parts 14. A brazing filler metal, not shown, filled in the grooves 16 is melted to braze the torsion bar 15 to the armature 8 and the supporting parts 14. In brazing the torsion bar 15 to the armature 8 and the supporting parts 14, the armature 8 is separated from the end surface (attracting surface) of the standing body 5 of the core 6. When the dot print head is assembled, the armature 8 is attracted to the core 6 by the magnetism of the permanent magnet 3 against the torsional resilience of the elastic portions 18 of the torsion bar 15.

When one specified solenoid 7 of the solenoid coils 7 is energized, the magnetism of the permanent magnet 3 is cancelled by that of the solenoid 7, so that the armature 8 is separated from the end surface of the core 6 by the restorative elasticity of the elastic portions 18 of the torsion bar 15, so that the stylus 10 advances toward the platen for printing. When the solenoid 7 is de-energized, the armature 8 is attracted to the end surface of the core 6 by the magnetism of the permanent magnet 3 elastically twisting the elastic portions 18 of the torsion bar 15.

Since the cores 6 are fixed to the permanent magnet, magnetic paths of a short length are formed individually between the permanent magnet and the armatures, respectively. Since the cores 6 are arranged zigzag at regular intervals in two straight rows, leakage of magnetic flux, and magnetic interference between the adjacent cores 6 are prevented. Furthermore, since the area of surface of the foot 4 of the core 6 in contact with the permanent magnet is greater than the area of end surface of the standing portion 5 of the same, the magnetism of the permanent magnet 3 can be used effectively and magnetic flux density in the end surface of the standing portion 5 of the core 6 is increased to apply a high magnetic attraction to the armature 8. Still further, since the styluses 10 are arranged in a single row, dot pitch on a vertical line perpendicular to the axis of the platen can be adjusted by mounting the dot print head with the yokes 1 and 2 at an inclination on a carriage which reciprocates along the platen so that the styluses 10 are arranged respectively on straight lines inclined slightly to a vertical line perpendicular to the horizontal axis of the platen. Since the leakage of magnetic flux and magnetic interference between the adjacent cores 6 can be prevented, any one of the solenoids can be energized at an optional moment, and thereby the dot pitch along the axis of the platen can be adjusted to an optional value.

Since the brazing filler metal is filled in the grooves 16 for receiving the torsion bar 15, no particular machining operation is necessary for forming holes for containing the brazing filler metal. The flanges 17 of the torsion bar 15 facilitates the axial positioning of the torsion bar 15, prevents the flow of the molten brazing filler metal over the elastic portions 18, and increases the area of contact of the brazing filler metal with the torsion bar 15 to enhance the brazing strength. The torsion bar 15 may be provided fixedly beforehand and the grooves 16 may be formed only in the supporting parts 14. On the contrary, the torsion bar 15 may be provided fixedly on the supporting parts 14 and the groove 16 may be formed only in the armature 8.

Since the grooves for receiving the torsion bar is used also for containing the brazing filler metal, no particular machining operation is necessary for forming holes or grooves for containing the brazing filler metal, and thereby steps of manufacturing process is reduced. Furthermore, since the flanges of the torsion bar are formed so as to be contiguous with the side walls of the armature and the supporting parts, the axial positioning of the torsion bar is facilitated and the flow of the brazing filler metal over the elastic portions is prevented, and the area of surface of the torsion bar in contact with the brazing filler metal is increased to enhance the brazing strength.

A dot print head in a second embodiment according to the present invention will be described hereinafter with reference to FIGS. 5 to 9, in which parts like or corresponding to those of the first embodiment are denoted by the same reference numerals. An upper yoke 2 is joined to the open end of a U-shaped lower yoke 1. A permanent magnet 3 is extended on the inner bottom surface of the lower yoke 1. A plurality of the solenoids 7 are mounted respectively on a plurality of cores 6 each having a foot 4 fixed to the permanent magnet 3, and a standing body 5. An armature 8 disposed opposite the core 6 has a plate-shaped arm 9 projecting from the free end of the body thereof, and a stylus 10 is fixed to the extremity of the arm 9. A stylus guide 11 for slidably guiding the styluses 10 is held on a nose 12 fixed to the upper yoke 2. Projections 13 and supporting parts 14 are formed integrally with the upper yoke 2 on the inner surface of the latter. Each armature 8 is disposed between the adjacent projections 13 and is connected to the supporting parts 14 by a torsion bar 15.

Figure 8:
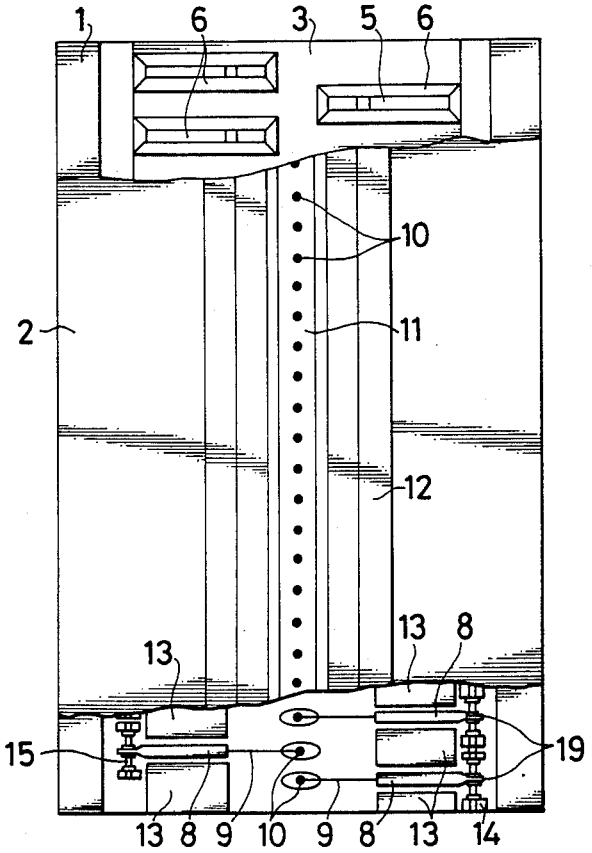
FIG. 8 is a partially cutaway plan view of the dot print head in the second embodiment according to the present invention.

In FIG. 8, an upper portion, as viewed in FIG. 8, of the upper yoke 2 is partially cut away and the solenoids 7 are omitted to show the arrangement of the cores 6, and a lower portion, as viewed in FIG. 8, of the upper yoke 2 is partially cutaway to show the arrangement of the armature 8, the projections 13 and the supporting parts 14. As shown in FIG. 8, a plurality of dot print units each comprising the core 6, the solenoid 7 and the armature 8 are arranged zigzag in two straight rows. The dot print units may be arranged in a circular arrangement.

Figure 7:
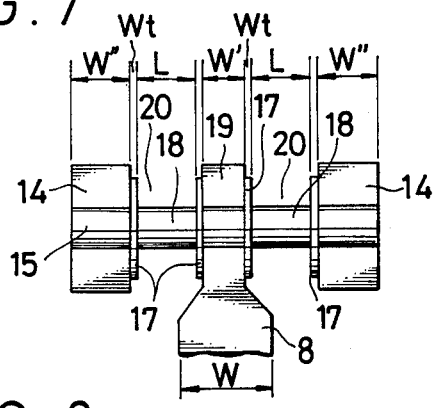
FIG. 7 is a plan view of the dot print unit of FIG. 5.

As shown in FIG. 7, each armature 8 has a main portion for forming part of a magnetic path in combination with the core 6, having a width W, and a base end 19 having a width W′ smaller than the width W of the main portion, and each supporting part 14 has a width W″ smaller than the width W of the main portion of the armature 8, so that comparatively large gaps 20 are formed between the opposite side surfaces of the base end 19 of the armature 8 and the corresponding side surfaces of the supporting parts 14, respectively. A torsion bar 15 is placed in U-shaped grooves respectively formed in the armature 8 and the supporting parts 14. The torsion bar 15 is formed of an elastic low-carbon nickel-rich alloy steel, has elastic portions 18 extending on the opposite sides of the base end 19 of the armature 8, and is provided integrally with flanges 17 contiguous with the opposite side surfaces of the base end 19 of the armature 8 and the side surfaces of the supporting parts 14, respectively. A brazing filler metal, not shown, filled in the grooves 16 is melted to braze the torsion bar 15 to the armature 8 and the supporting parts 14. In brazing the torsion bar 15 to the armature 8 and the supporting parts 14, the armature 8 is separated from the end surface (attracting surface) of the standing body 5 of the core 6. When the dot print head is assembled, the armature 8 is attracted to the core 6 by the magnetism of the permanent magnet 3 against the torsional resilience of the elastic portions 18 of the torsion bar 15.

When one specified solenoid 7 of the solenoids 7 is energized, the magnetism of the permanent magnet 3 is cancelled by that of the solenoid 7, so that the armature 8 is separated from the end surface of the core 6 by the restorative elasticity of the elastic portions 18 of the torsion bar 15, so that the stylus 10 advances toward the platen for printing. When the solenoid 7 is de-energized, the armature 8 is attracted to the end surface of the core 6 by the magnetism of the permanent magnet 3 elastically twisting the elastic portions 18 of the torsion bar 15.

Thus, the comparatively large gaps 20 are formed by forming the base end of each armature 8 and each supporting part 14 respectively in the comparatively small widths W′ and W″ to enable the elastic portions of each torsion bar 15 to be formed in a sufficiently large length L. Accordingly, stress in the elastic portions 18 and the strength of the same can optionally be adjusted.

Figure 9:
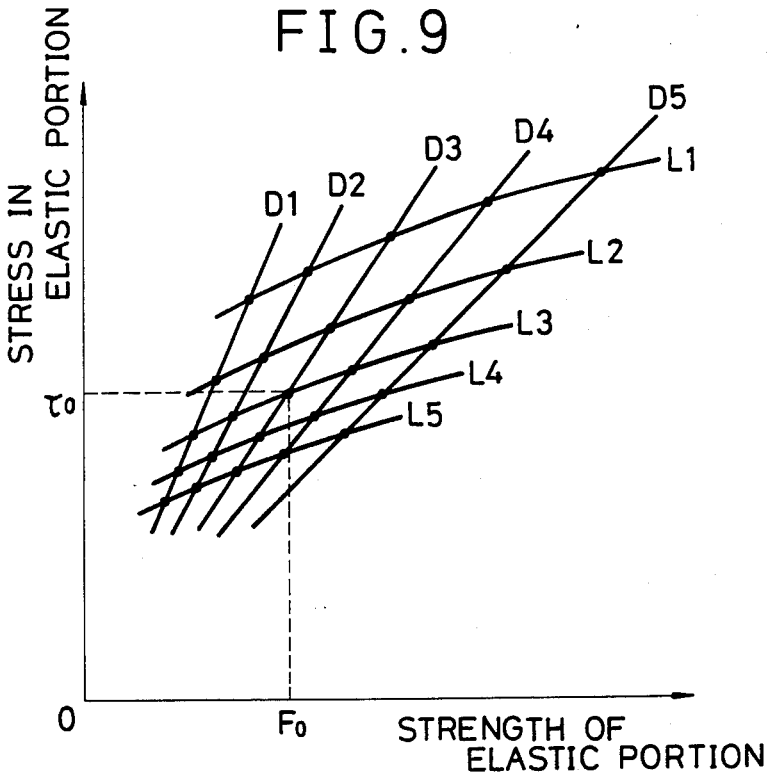
FIG. 9 is a graph showing stress in the torsion bar and strength of the torsion bar for the length and diameter of the torsion bar.
Figure 10:
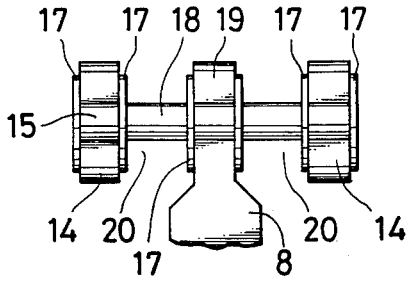
FIG. 10 is a plan view of a modification of the dot print unit of FIG. 1.

FIG. 9 shows the relation between the strength of the elastic portion 18 and stress in the elastic portion 18 for the length of the elastic portion 18. In FIG. 9, L1, L2, L3, L4 and L5 are lengths of the elastic portions 18, D1, D2, D3, D4 and D5 are diameters of the elastic portion 18, in which $L1<L2<L3<L4<L5$, and $D1<D2<D3<D4<L5$. Suppose that a desired strength of the elastic portion is $F_0$ and a desired stress in the elastic portion is $\tau_0$. Then, the stress is nearly equal to the desired stress whereas the strength is insufficient when the diameter is D1 and the length is L2. When the diameter is D3 and the length is L2, the strength is sufficient whereas the stress is excessively large. When the length is L3 and the diameter is D3, the strength and the stress are equal to the desired strength and the desired stress, respectively. However, when a strength higher than the strength $F_0$ is desired to enable the armature 8 to operate at a high speed, the stress in the elastic portion 18 exceeds the desired stress. Accordingly, when the elastic portion 18 has a sufficient length, such as the length L5, the diameter of the elastic portion 8 can be selected from diameters in a comparatively wide range of diameter without causing the stress to increase beyond the desired stress $\tau_0$.

Although the width W' of the base end of the armature 8 and the width W'' of the supporting parts 14 are comparatively small, the area of brazing surface is increased by the flanges 17 of the torsion bar 15 to secure sufficient strength in brazing the torsion bar 15 to the supporting parts 14.

Furthermore, the dot print head can be formed in a further small size by disposing the armatures 8 and the supporting parts 14 respectively in comparatively small spaces. When the thickness Wt of the flange 17 meets inequalities: $2Wt<W-W'$ and $Wt<W-W''$, the length of the elastic portions 18 can be increased while the length of the torsion bar 15 and the distance between the respective outer side surfaces of the adjacent supporting parts 14 are reduced, which enables the armatures 8 to be arranged at a reduced pitch to curtail the size of the dot print head. The thickness of the flanges 17 can be reduced without entailing problem in the strength of the torsion bar 15 because no thrust force acts on the torsion bar 15. The effect of flanges having a comparatively small thickness on preventing the flow of the brazing filler metal over the elastic portions 18 is the same as that of flanges having a comparatively large thickness.

When a torsion bar 15 having flanges 17 contiguous with the respective opposite side surfaces of the supporting parts 14 and the base end of the armature 8 is used, brazing strength in brazing the torsion bar 15 to the supporting parts 14 14 is further increased, and hence the width of the supporting parts 14 can further be reduced, which enables the further increase in the length of the elastic portions 18 or the further reduction in the space in which the armatures 8 and the supporting parts 14 are arranged.

Further embodiments of the present invention will be described hereinafter with reference to FIGS. 11 to 18, in which parts like or corresponding to those previously described with reference to FIGS. 1 to 10 are denoted by the same reference numerals and the description thereof will be omitted.

Figure 11:
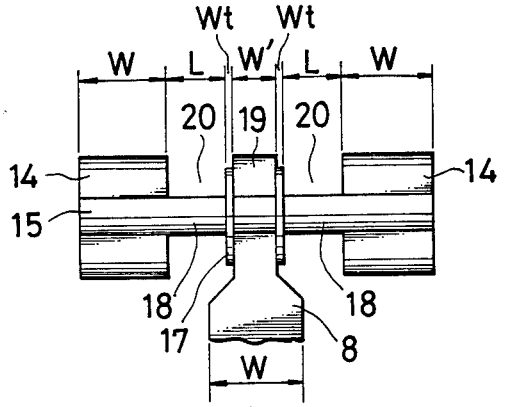
FIGS. 11 to 18 are fragmentary plan views of dot print units incorporated into further embodiments according to the present invention.

Second Embodiment (FIG. 11)

The width W of the supporting parts 14 is equal to the width W of the main body of an armature 8, and the width of the base end of the armature 8 is reduced to W' smaller than the width W of the main body of the same to secure comparatively large gaps 20 between the base end of the armature 8 and the supporting parts 14 so that a torsion bar 15 having elastic portions 18 having a necessary length L can be used and the armatures 8 and the supporting parts 14 can be arranged in a comparatively small space.

Figure 12:
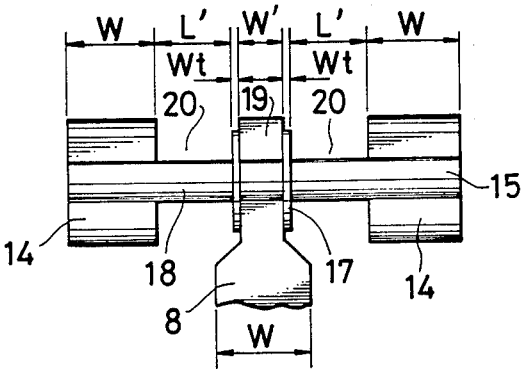

Third Embodiment (FIG. 12)

The length of each elastic portion 18 of a torsion bar 15 is increased by a length equal to the difference between half of the difference between the width W of the main body of an armature 8 and the width W' of the base end of the armature 8, and the thickness Wt of a flange 17 of the torsion bar 15, and hence the length L' of the elastic portion is greater than the length L of the elastic portion 18 in the second embodiment. Thus, the strength of the elastic portion 18 of the torsion bar 15 in the third embodiment is increased, the elastic portion 18 has sufficient durability, stress in the elastic portion 18 is reduced, and the torsion bar 15 in the third embodiment enables the armature 8 to operate at a high speed.

Figure 13:
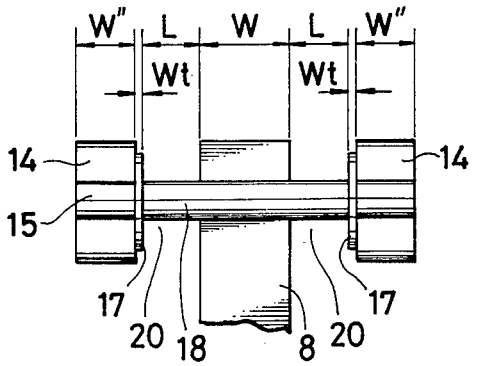
Figure 14:
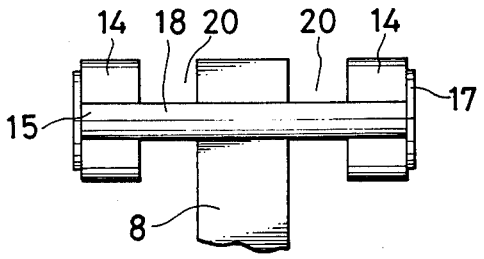
Figure 15:
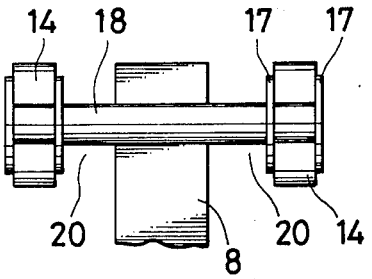

Fourth, Embodiment (FIGS. 13 to 15)

An armature 8 has a main body and a base end having the same width W while supporting portions 14 have a reduced width W', so that gaps 20 having a necessary width are formed between the armature 8 and the supporting parts 14, a torsion bar 15 having elastic portions 18 having a sufficient length L can be employed, and the armatures 8 and the supporting parts 14 can be arranged in a reduced space. Flanges 17 are formed in the torsion bar 15 so as to be contiguous with the inner side surfaces of the supporting parts 14 (FIG. 13), with the outer side surfaces of the supporting parts 14 (FIG. 14) or with the respective inner and outer surfaces of the supporting parts 14 (FIG. 15) so that the thickness of the supporting parts 14 can further be reduced, to secure sufficient brazing strength in brazing the torsion bar 15 to the supporting parts 14.

Figure 16:
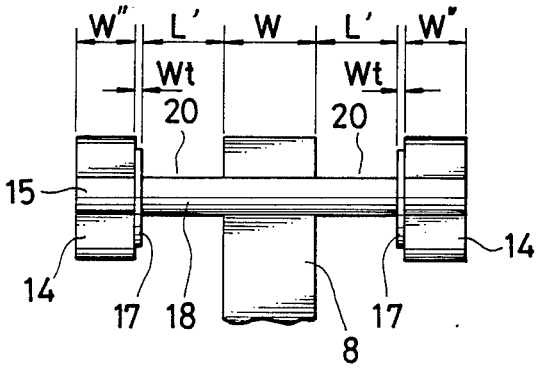

Shown in FIG. 16 is a modification of the construction shown in FIG. 12, in which the width W'' of supporting portions 14 is smaller than the width W of the supporting portions 14 in FIG. 12 to increase the width of a gap 20 between the side surface of an armature 8 and the inner side surface of the corresponding supporting member 14, so that the length L' of the elastic portion 18 of a torsion bar 15 is increased accordingly relative to the length L of the elastic portion 18 of the torsion bar 15 of FIG. 12.

Figure 17:
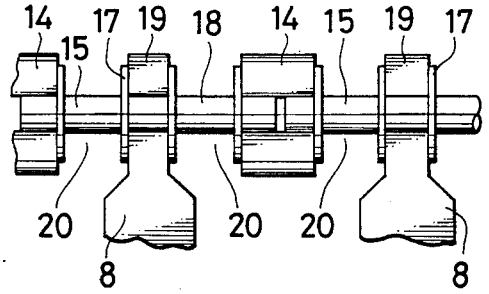

Fifth Embodiment (FIG. 17)

The width of the base end of an armature 8 and that of supporting parts 14 are reduced, flanges 17 are formed in a torsion bar 15 so as to be contiguous with the respective opposite side surfaces of an armature 8 and the supporting parts 14, only one of the supporting parts 14 is disposed between the adjacent armatures 8 to support both the adjacent ends of the adjacent torsion bars 15 so that the length of the elastic portions 18 of the torsion bars 15 is increased and the space for arranging the armatures 8 and the supporting parts 14 can effectively be reduced.

Figure 18:
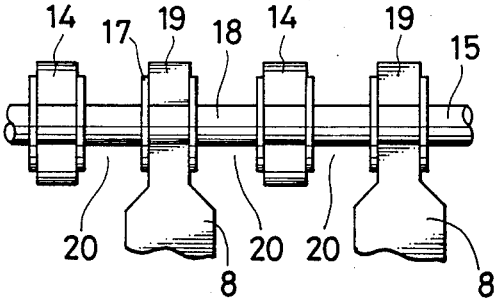
Figure 19:
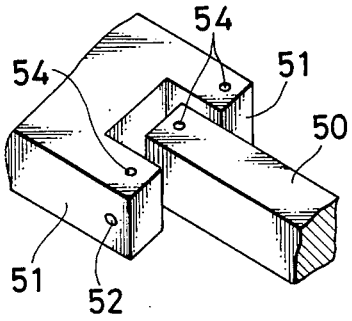
FIG.19 (PRIOR ART)
FIG. 19 is an enlarged fragmentary perspective view of a dot print unit incorporated into a conventional dot print head.
Figure 20:
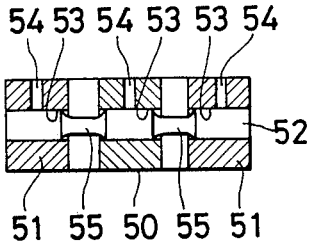
FIG.20 (PRIOR ART)
FIG. 20 is a longitudinal sectional side elevation of the dot print unit of FIG. 19.
Figure 21:
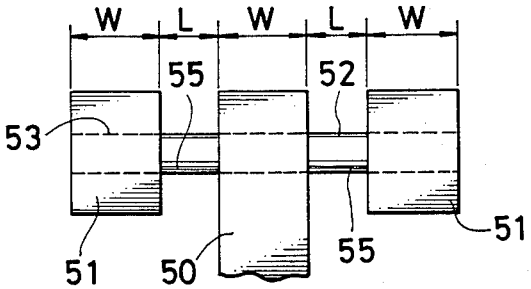
FIG.21 (PRIOR ART)
FIG. 21 is a plan view of the dot print unit of FIG. 19.

Sixth Embodiment (FIG. 18)

A single torsion bar 15 is supported on a plurality of supporting parts 14 to support a plurality of armatures 8, which enables the further reduction of the width of the supporting parts 14.

As is apparent from the foregoing description, according to the present invention, the torsion bar is placed in the grooves formed in the supporting parts and the armature and is brazed to the supporting parts and the armature to connect the armature and the supporting parts by the torsion bar. A comparatively wide gap is formed between the armature and the supporting part by reducing the width of the base end of the armature of that of the supporting part. Accordingly, the elastic portions can be formed in the torsion bar in a sufficiently large axial length, and hence the stress in the elastic portions and the strength of the elastic portions can optionally be determined. On the other hand, since the flanges are formed on the torsion bar so as to be contiguous with the side surfaces of the armature and/or those of the supporting parts, a sufficiently large brazing strength can be secured in brazing the torsion bar to the armature and the supporting parts even if the width of the armature and/or that of the supporting parts is reduced. The reduction in the width of the armature and/or that of the supporting parts enables the reduction in size of the dot print head through the reduction of a space for arranging the armatures and the supporting parts.

What is claimed is:

1. A dot print head comprising: a plurality of cores; a plurality of solenoids mounted respectively on the cores, the magnetism of each solenoid being varied for printing; a plurality of supporting parts; a plurality of armatures disposed respectively opposite the cores and between the adjacent supporting parts, each armature being allowed to be turned so as to move a stylus held thereon toward a platen for printing by selectively varying the magnetism of the corresponding solenoid; and torsion bars each having elastic portions so as to extend on the opposite sides of the armature and connecting the armature and the adjacent supporting parts; wherein an open groove for receiving the torsion bar and for containing a brazing filler metal for brazing the torsion bar is formed at least in either the armature or each supporting part, and flanges are formed integrally with the torsion bar so as to be positioned between the elastic portions and the opposite ends of the open grooves respectively, said open groove extending across the entire width of said armature and said supporting parts, whereby said torsion bar is inserted into said open groove in a direction transverse to the axial direction of said torsion bar.

2. A dot print head as claimed in claim 1, wherein the minimum width of said groove is not less than the diameter of said torsion bar, whereby said tension bar can be inserted into said open groove.

3. A dot print head comprising: a plurality of supporting parts arranged at predetermined intervals; and a plurality of armatures each fixedly holding a stylus at the free end thereof and disposed between the adjacent supporting parts and opposite a core mounted with a solenoid; wherein open grooves are formed respectively in the base end of each armature and the supporting parts to receive torsion bars each having elastic portions formed integrally therewith so as to extend on the opposite sides of the armature and for brazing the torsion bars to the armatures and the supporting parts, the width of the base end of each armature is reduced to form a gap between the armature and the supporting part in a width sufficient to form the elastic portion of the torsion bar in a length greater than a predetermined value, and flanges are formed integrally with the torsion bar so as to be contiguous with the opposite side surfaces of the base end of the armature, said open grooves extending across the entire width of said armature and said supporting parts, whereby said torsion bar is inserted into said open groove in a direction transverse to the axial direction of said torsion bar.

4. A dot print head comprising: a plurality of supporting parts arranged at predetermined intervals; and a plurality of armatures each fixedly holding a stylus at the free end thereof and disposed between the adjacent supporting parts and opposite a core mounted with a solenoid; wherein open grooves are formed respectively in the base end of each armature and the supporting parts to receive torsion bars each having elastic portions formed integrally therewith so as to extend on the opposite sides of the armature and for brazing the torsion bars to the armature and the supporting parts, the width of the supporting parts is reduced to form a gap between the armature and the supporting part in a width sufficient to form the elastic portion of the torsion bar in a length greater than a predetermined value, and flanges are formed integrally with the torsion bar so as to be contiguous with the opposite side surfaces of the supporting parts, said open grooves extending across the entire width of said armature and said supporting parts, whereby said torsion bar is inserted into said open groove in a direction transverse to the axial direction of said torsion bar.

* * * * *